United States Patent [19]

Taylor et al.

[11] 3,953,015

[45] Apr. 27, 1976

[54] CEILING HANGER

[75] Inventors: John D. Taylor; Tommy R. Whitmer, both of Frederick, Okla.

[73] Assignee: Goldblatt Tool Company, Kansas City, Kans.

[22] Filed: Oct. 11, 1974

[21] Appl. No.: 514,117

[52] U.S. Cl. ..... 269/46; 52/DIG. 1; 248/317; 248/327; 269/321 S

[51] Int. Cl.[2] ..... E04G 17/18

[58] Field of Search ..... 29/200 P, 270; 52/486, 52/DIG. 1; 248/323, 327, 317, 343; 269/46, 289, 321 S

[56] References Cited

UNITED STATES PATENTS

| | | | |
|---|---|---|---|
| 1,260,123 | 3/1918 | Areson | 248/327 |
| 3,142,898 | 8/1964 | Swenick et al. | 29/270 |

FOREIGN PATENTS OR APPLICATIONS

| | | | |
|---|---|---|---|
| 34,700 | 7/1964 | Germany | 248/327 |

*Primary Examiner*—Al Lawrence Smith
*Assistant Examiner*—James G. Smith
*Attorney, Agent, or Firm*—Watson D. Harbaugh

[57] ABSTRACT

A tool for temporarily holding one or both ends of a piece of wallboard or plaster-board adjacent a ceiling joist to assist in nailing or otherwise fastening the board to the joist is disclosed. In one embodiment the tool includes a right angle plate with a handle at the bottom and an inverted U-shaped flange along the top edge for engagement over a joist as the end edge of the wallboard is carried and supported by the plate. The U-shaped flange is dimensioned from the plate so as to be engageable of joists of different widths. In another embodiment the inverted U-shaped flange is adjustable so that different widths of joists can be accommodated to bring the end edge of the wallboard relatively close to the bottom edge of the joist for convenience in nailing.

6 Claims, 8 Drawing Figures

FIG 3
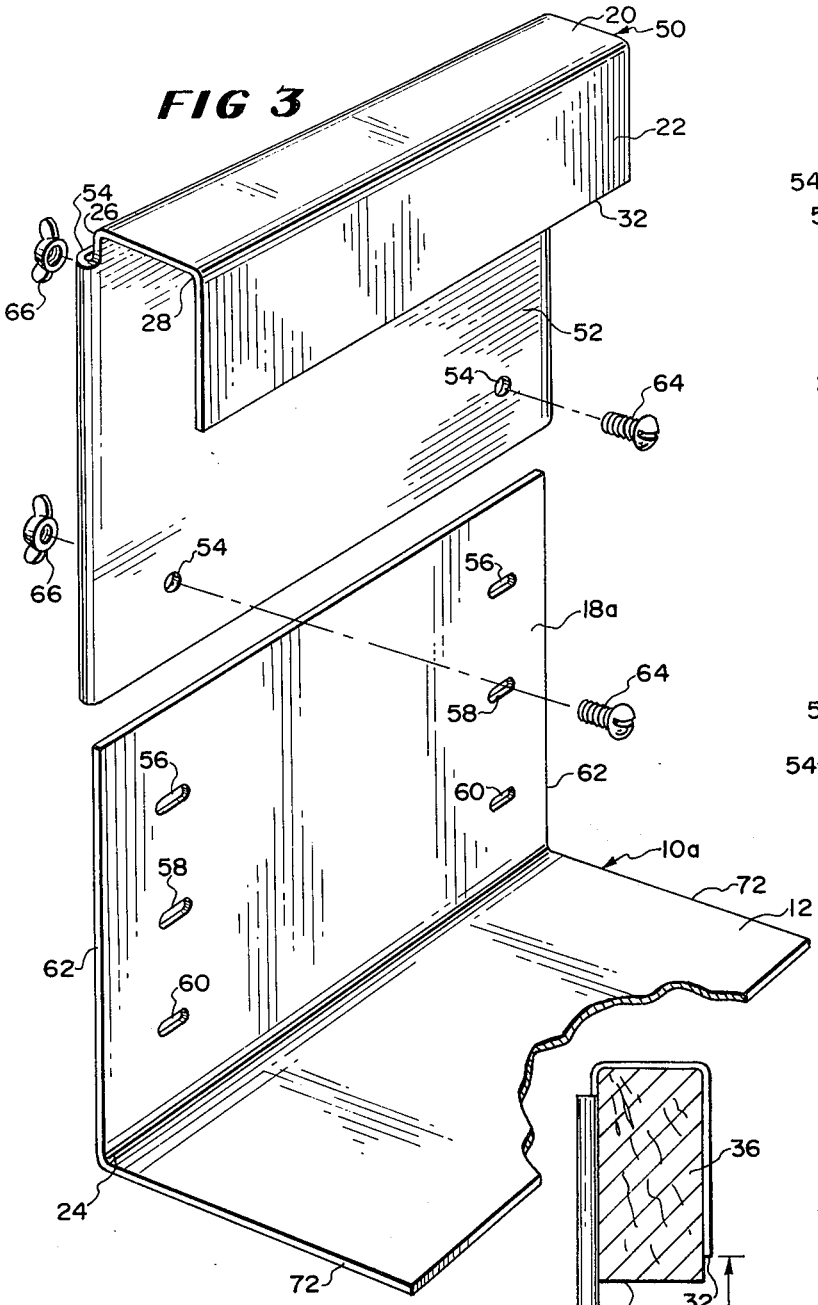
FIG. 4
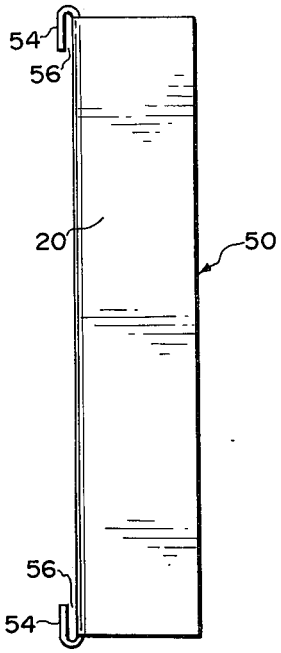
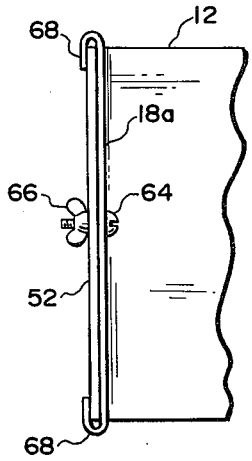
FIG. 6
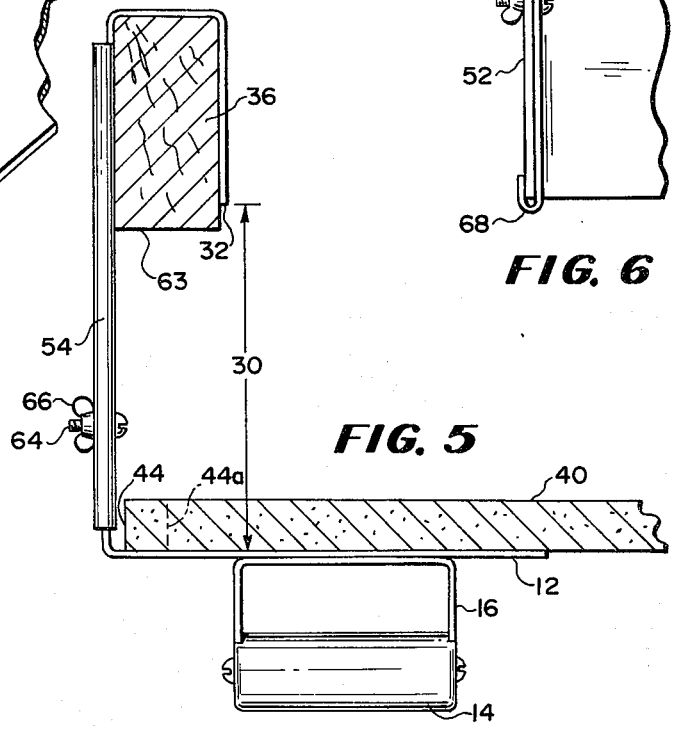
FIG. 5

CEILING HANGER

BACKGROUND OF THE INVENTION

The prior art does not provide a tool that is intended for use in accordance with this invention. At best, the prior art discloses various forms of sheet metal clips for permanent engagement over a joist and including a channel to receive the end edge of the wallboard or plaster-board and hold it in juxtaposition with the joists. Such structures comprising permanent clips are illustrated by CRYSLET U.S. Pat. No. 1,854,645; TAYLOR U.S. Pat. No. 1,862,391; VENZIE U.S. Pat. No. 1,891,511; BURSON U.S. Pat. No. 2,227,570; BOLINSKI U.S. Pat. No. 3,144,733 and POHUTSKY U.S. Pat. No. 3,343,329. Other forms of so-called furring clips are illustrated in MAKOWSKI U.S. Pat. No. 1,600,561; VENZIE U.S. Pat. No. 2,259,594; NELSSON U.S. Pat. No. 2,668,342 and SIERLING U.S. Pat. No. 3,020,602.

A plurality of these devices is used along the edges of the wallboard and attention is given to such factors as the elimination of nailing while still holding the wallboard tightly against the wall or ceiling supports as well as providing a permanent mounting which is easily attached and hidden from view.

In spite of the existence of these sheet metal clips in the art, the most practical and rapid method of attaching wallboard to ceiling joists is nailing. The only real drawback to this method is the step of holding the wallboard overhead against the joists in proper position for nailing. It is extremely difficult and time consuming for one man to accomplish such ceiling installations and usually two men are employed, one to place and hold the wallboard against the joists, at least at one end, while seeing to it that the other end is also in its proper position, while the second man, assisting in the holding operation must drive the nails. Obviously, two men working together can raise and hold the wallboard into position against the joists and both can participate in the nailing. But even so, it is a tedious undertaking considering the weight of these panels and some expertise in one-handed nail placement and driving is required. The labor costs involved off-set the practical and inexpensive aspects of using nails as the fastening means.

SUMMARY OF THE INVENTION

The instant invention overcomes these and related problems by providing an inexpensive and practical tool that allows one man to hang a ceiling of wallboard or plaster-board (dry wall) with less effort and time than if he had a helper. With the tool of this invention, one man can temporarily suspend one end of the plaster-board against a ceiling joist without fear of its dislocation while he raises the other end into position for nailing. The tool holds the one end in close proximity to the joist so that the other end can be properly nailed with little effort. Once the plaster-board is fastened in place the tool is removed from over the joist and ready for use on the next panel. The tool is first placed over the joist end and provides a platform to hold the end of the plaster-board close enough and with sufficient clearance so that its longitudinal edge can be properly aligned with and abutted against the edges of the wall studding or edge of a previously installed plaster-board on the ceiling prior to nailing.

The tool comprises, in one embodiment, a unitary sheet metal or plastic plate member bent or formed to define a flat base and an upright wall having an inverted U-shaped flange along its top edge to engage over a joist member which may be a 2 × 4 and which is normally a 2 × 6 or 2 × 8 or 2 × 12. The U-shaped flange includes a depending inner wall, the lower edge of which is spaced sufficiently from the flat base to allow the tool to be removed after the plaster-board is nailed in place. A handle member is provided on the bottom of the flat base to facilitate use of the tool.

In another embodiment of the upright wall and U-shaped or box flange are adjustable in height in relation to the base to accommodate different widths of joist and at the same time bring the plaster-board in the closest proximity of the lower edge of the joist for easier nailing. Other embodiments and alternative structures including side extensions and a spacer corner are disclosed.

DESCRIPTION OF THE DRAWINGS

The invention is illustrated by the drawings wherein:

FIG. 3 is an exploded view of a modified tool in accordance with this invention having means to adjust the effective height of the top U-shaped flange in relation to the flat base;

FIG. 4 is a top plan view of the adjustable U-shaped flange shown in FIG. 3;

FIG. 5 is a cross-sectional view of the tool of FIG. 3 in assembled condition shown suspending a plaster-board upon a joist member;

FIG. 6 is a fragmentary view of an alternative structure from that shown in FIGS. 3, 4 and 5, wherein the telescoping relationship is reversed;

Figure 1:
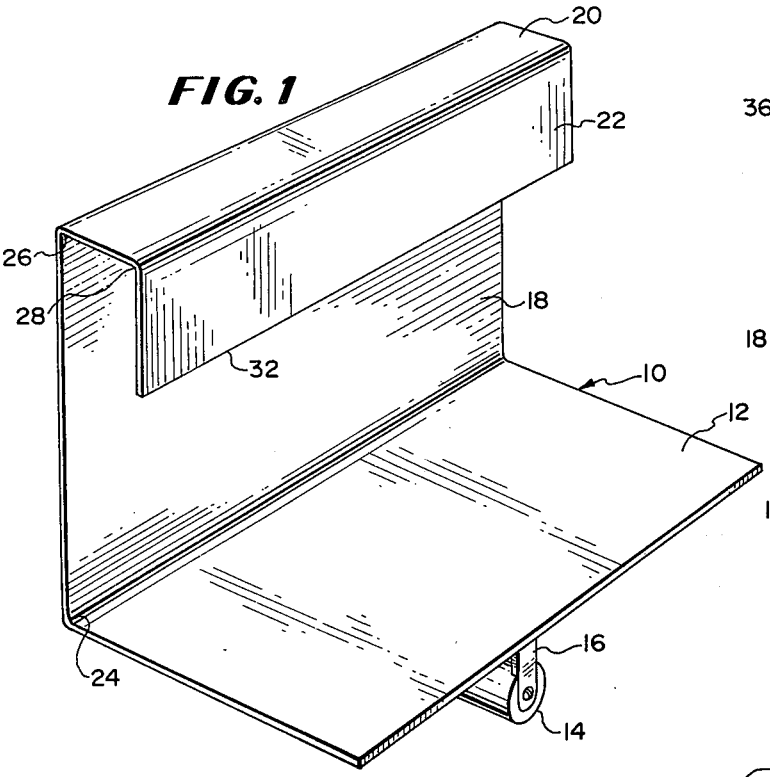
FIG. 1 is a perspective view of the tool of this invention oriented in the position in which it is used.
Figure 2:
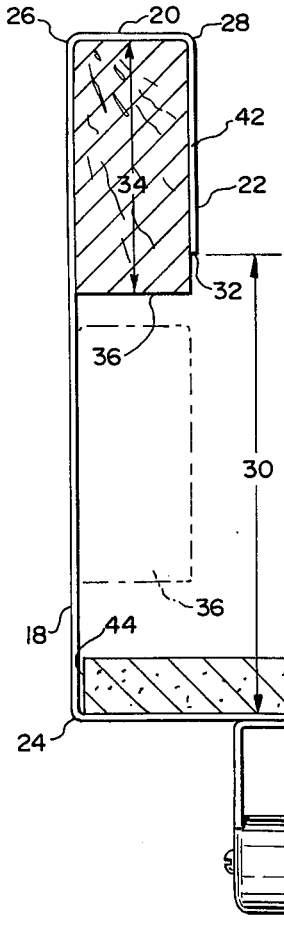
FIG. 2 is a cross-sectional view of the tool of FIG. 1 taken through a joist, upon which the tool is hanging, and through a panel of plaster-board supported thereby with the initial position of the tool in relation to the joist before hanging shown by the broken line position of the joist.

DESCRIPTION OF THE PREFERRED EMBODIMENTS:

Referring to FIGS. 1 and 2, an embodiment of the invention is shown by the tool 10 comprising the base plate 12 having the handle member 14 attached to the bottom thereof by means of the bracket 16 which can be welded or otherwise attached thereto. The handle 14 is normally located at about the geometric center of the base plate 12 and can have its longitudinal axis extending perpendicular to the end edge of a piece of plaster-board or parallel thereto.

The base plate 12 is connected to or integral with the upright wall 18 which terminates in the inwardly extending transverse top wall member 20 and is provided with the depending flange 22. This forms an inverted U-shaped flange, the open bottom of which faces the plate 12. The wall 18 can be integral with the top wall member 20 and the latter integral with the depending flange 22 whereby the entire tool is formed by simply bending the corners 24, 26 and 28 therein, and the tool fabricated from a single sheet of metal such as steel. Alternatively these parts can be separately fabricated and welded or otherwise affixed along the respective corners shown. Various known forms of structural plastic compositions can be used to form these parts of the tool 10.

The dimensions of these parts are not critical except that the distance 30 from the bottom edge 32 of the depending flange 22 to the top surface of the bottom plate or base 12 must be at least equal to and is obviously slightly greater than the width 34 of a joist 36 plus the thickness of a piece of plaster-board 40. Thus the distance 30 is preferably sufficient to allow the edge 32 to clear the top of a joist with a piece of plaster-board attached to the bottom edge of the joist.

In FIG. 2, the joist 36, shown in broken lines, represents the position of the tool 10 relative thereto at the time the tool is about to be hooked on the joist before the plaster-board is placed on the base plate 12. In this embodiment the space 30 is more than adequate to be used with joists up to about 6 inches in width. It is obvious that in order for the depending flange 22 to pass over the joist 36 as shown in FIG. 2 with the top wall 20 in supporting or hanging relationship, the lateral distance between the upright plate or wall 18 and the inside of the flange 22 must be at least the same as and preferably greater than the thickness of the joist 36. For ease of attachment a slight spacing would be provided as indicated at 42.

In order to use the embodiment of the tool shown in FIGS. 1 and 2, the tool is first hung on the joist 36, then the worker places the wallboard 40 on the plate 12 and pushes the edge 44 toward the upright wall 18 until the other edge is in nailing position for its joist. This end is then nailed and the worker goes to the end held by the tool, raises it into position and nails it. The tool may also be used by placing the end edge 44 of a piece of plaster-board 40 thereon and raising the tool by means of the handle 14, while supporting and balancing the plaster-board thereon, to a position with the U-shaped flange above the joist 36. The tool is then lowered so that it hooks thereon as shown in FIG. 2. Then the other end is further raised to the corresponding joist (not shown) and properly nailed thereto. The manner of use depends on the weight of wall-board and the desire of the workman.

If a previous plaster-board has been attached to these joists, the side edge of the plaster-board being attached can be readily aligned with the previous board by manipulating the tool of the board sideways. Following this, the end 44 is raised from the base plate 12, while the tool still hangs on the joist, to contact the joist 36 and is suitably nailed. As soon as two or more nails have been driven through the plaster-board into the bottom edge of the joist 36, the tool is removed by raising it to disengage the flange 22 and the nailing can be completed along the area formerly occupied by the tool.

If desired, two tools can be used, one at each end of a panel of plaster-board, or one at the respective ends of adjacent plaster-boards for faster installation simultaneously by a pair of workers. The top surface of the base plate 12 can include a layer of non-skid material, if desired.

In the embodiment of FIGS. 3, 4 and 5, the same basic parts are included in the tool 10*a*, except that the U-shaped flange 50, defined by the top wall 20 and the depending side wall or flange 22 along with the plate 52, is a separate and adjustable unit, having the inturned side edges 54 which define a pair of open sided opposed channels 56 adapted to telescope upon the altered side plate 18*a*. The bottom or base plate 12 and handle 14 remain the same.

For this purpose the side plate 52 includes a pair of spaced holes 54 and the side plate 18*a* has 3 pairs of slots indicated at 56, 58 and 60, arranged along parallel spaced vertical axes. By this structure it is apparent that the separable U-shaped flange 50 can be placed upon the wall 18*a* with its side edges 62 within the channels 56 and the holes 54 will register with a desired pair of slots 56, 58 or 60 to receive the bolts 64 therethrough for attachment of the wing nuts 66. Thus, with this attachment being at the lower slots 60, the height 30 from the plate 12 to the lower edge 32 of the depending flange 22 can be such as to accommodate 2 × 4 joists and wallboards of several different thicknesses. Attachment at the slots 58 can accommodate 2 × 6s while attachment at the slots 56 can accommodate 2 × 8s. The side plate 18a can be dimensioned for larger joists if desired. In some instances only one central row of slots 56, 58 and 60 can be used with only a single hole 54 and a single bolt 64. The slots facilitate alignment with the holes 54 for insertion of the bolts 64. The upright plate 18*a* can include indicia thereon opposite the slots 56, 58 and 60 to show the size of the various adjustments.

The purpose of this adjustability is, of course, to hold the top surface of the plaster-board 40 in close and properly squared proximity to the lower edge 63 of the joist 36 so that lifting to nail is a minimum, once the board is in the hanging position at one end.

In the event the joist 36 is an intermediate joist to which adjoining plaster-boards to be attached end-to-end, placement of the other end of the plaster-board 40, in FIG. 5, to the center of its joist or in abuttment with an edge of a plaster-board already fastened thereto, will move the edge 44 to the broken line position 44a so that a similar abutting joint can be made on the intermediate joist thereabove.

Alternatively the side edges 72 of the base plate 12 can extend beyond the side edges 62 of the upright member 18*a* so that the effective supporting area of the former is increased. Extensible means can also be used as in FIG. 7.

Figure 7:
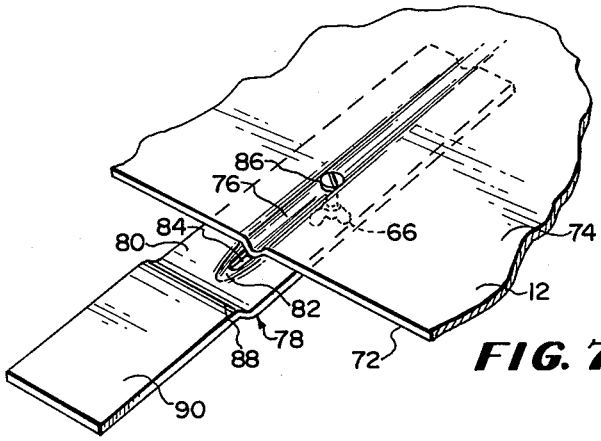
FIG. 7 is a fragmentary view of the side portion of the base plate including an adjustable supporting arm for wider plaster-boards or better lateral balance of the plaster-board.

Thus, FIG. 7 shows a portion of the base plate 12 with the side edge 72 and the top surface 74 including a channel 76 which can be stamped therein. The adjustable side arm 78 is provided with the flat portion 80 having the mating channel 82 therealong with the longitudinal slot 84 in the bottom of this channel. The top channel 76 has a suitable hole to receive the bolt 86, the head of which can be flat so as to be recessed in the channel 76. The bolt 86 extends through the slot 84 and the wing nut 66 attaches thereto which, upon tightening, holds the side arm 80 in any desired extended position along the length of the slot 84. The side arm 80 is upturned at 88 to bring the top end portion 90 into the plane of the surface 74. One such side arm 80 can be used at either or both edges 72 of the base plate 12.

The flange 22 in all embodiments of the invention need only be sufficiently wide or deep to extend far enough over the side of the joist 36 for proper retention. For heavy-duty use, sheet metal or plastic of heavy wall thickness can be used. The handle 14 can be in the form of a pole and be adjustable in length. The handle 14 is preferably held in non-rotatable relationship in the bracket 16. The tool 10 of FIGS. 1 to 7 can also be furnished without the handle 14. The corner 24 and upright wall 18 or 18*a* provides a squaring surface against which the end edge 44 of the plaster-board can be moved for alignment with an adjacent panel to insure proper installation.

Figure 8:
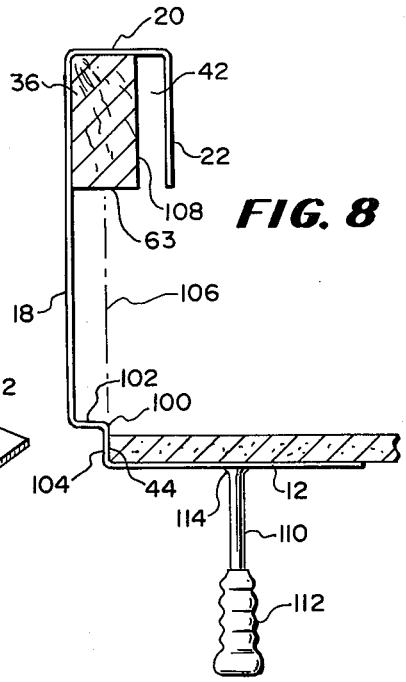
FIG. 8 is an end view of a modified tool with a spacer crimp along the inside corner at the bottom plate.

In FIG. 8 another embodiment is shown wherein the upright wall 18 has been modified to include the inwardly off-set corner 100, defined by the horizontally extending transverse wall 102 and the adjoining vertical wall 104 along the juncture of the wall 18 with the base plate 12. The corner 100 extends along the width of the plates 12 and 18 or can be a series of spaced indentations formed therein to accomplish this same purpose. This off-set corner can be made to be about one-half the effective width of the joist 36 so that when the inner surface of the upright wall 18 is brought against the left hand side of the joist, the end edge 44 of the panel 40, aligned therewith, is, positioned at about the center line 106 of the joist for nailing that panel along that center line so that the next panel can abut thereto on the remaining half of the width of the joist. This off-set corner or spacer 100 also automatically places the other end of the ceiling panel 40 on the center of the associated joist.

The space 42 in this instance can be a clearance space as shown in FIG. 2 or also dimensioned to equal approximately one-half the effective width of the joist 36. Thus, the tool shown in FIG. 8 with the wallboard 40 against the off-set corner 100 can be moved so that the depending flange 22 is against the side 108 of the joist 36, which will position the panel 40 flush with the entire bottom 63 of the joist. The tool of FIG. 8 includes an elongated handle 110 with a hand grip 112 at the end. The rod or handle 110 can be adjustable in length and attached to the plate by any means such as the weldment 114. In dimensioning the parts of the tool of this invention consideration is given to the fact that a 2 × 6 actually measures something less than 2 inches by 6 inches, for example, and slight variations in the joists of a building will occur in any one ceiling.

What is claimed is:

1. A tool to temporarily support an end of a ceiling panel from a joist for subsequent attachment thereto comprising:

a base plate having a vertical wall portion along one edge;

said vertical wall portion including separable overlapping planar wall members;

an inverted U-shaped flange portion along the top edge of one of said wall members;

said inverted U-shaped flange portion being adapted to hang over the top edge of a ceiling joist with said base plate extending thereunder to receive and support an end edge of a ceiling panel;

at least a pair of vertically spaced holes in one of said planar wall members and at least one hole in the other wall member; and fastening means are provided to engage through said holes while in registered positions to hold said planar wall members in at least two extended overlapping heights to accommodate joists of different widths;

the effective distance between the open bottom of said U-shaped flange and the top of said base plate at any one position being greater than the width of said joists plus the thickness of said ceiling panel so that after attachment of said ceiling panel to said joist, said tool can be raised to clear said joist and be removed therefrom.

2. A tool in accordance with claim 1 in which:

said one of said planar wall members is provided with edge channels that engage the edges of the other in telescoping guided relationship.

3. A tool to temporarily support an end of a ceiling panel from a joist for subsequent attachment thereto comprising:

a base plate having a vertical wall portion along one edge;

an inverted U-shaped flange portion along the top edge of said wall portion having its open bottom facing and spaced from the top surface of said base plate;

said inverted U-shaped flange portion being adapted to hang over the top edge of a ceiling joist with said base plate extending thereunder to receive and support an end edge of a ceiling panel; and said base plate including an extensible member on a side edge to extend the effective area of support under said ceiling panel;

the effective distance between the open bottom of said U-shaped flange and the top of said base plate being greater than the width of said joist plus the thickness of said ceiling panel so that after attachment of said ceiling panel to said joist, said tool can be raised to clear said joist and be removed therefrom.

4. A tool to temporarily support an end of a ceiling panel from a joist for subsequent attachment thereto comprising:

a base plate having a vertical wall portion joined thereto along one edge;

an inverted U-shaped flange portion along the top edge of said wall portion having its open bottom facing and spaced from the top surface of said base plate;

said inverted U-shaped flange portion being adapted to hang over the top edge of a ceiling joist with said base plate extending thereunder to receive and support one end of a ceiling panel;

the juncture of said base plate and said vertical wall portion being inwardly off-set to define a spacer abutment to position said one end edge of said ciling panel centrally of said joist and position its other end edge at the center line of an associated joist;

the effective distance between the open bottom of said U-shaped flange and the top of said base plate being greater than the width of said joist plus the thickness of said ceiling panel so that after attachment of said ceiling panel to said joists, said tool can be raised to clear said joist and be removed therefrom.

5. A tool in accordance with claim 4 in which:

the open bottom defined by said flange portion defines a channel which is about half again as wide as the thickness of said ceiling joist whereby said tool supporting said one end edge of said ceiling panel when moved laterally within the confines of said channel upon said joist aligns said one end edge of said ceiling panel with a side of said joist.

6. A tool to temporarily support an end of a ceiling panel from a joist for subsequent attachment thereto and in proper alignment with an associated joist comprising:

a base plate with an integral vertical wall portion degining at its top edge an integral U-shaped open-bottomed flange portion facing and spaced from the top surface of said base plate;

said base plate including an extensible member on a side edge to extend in the plane thereof an increase the effective area of support; and handle means on the bottom central portion of said base plate whereby said U-shaped flange portion is engageable over and upon the top edge of said joist to support said base plate in a position receive an end of said ceiling panel and support same adjacent and spaced from the under edge of said joist as the opposite end of said panel is being attached to an associated joist.

* * * * *